US007944675B2

(12) United States Patent
Chang

(10) Patent No.: US 7,944,675 B2
(45) Date of Patent: May 17, 2011

(54) NEGATIVE ION GENERATING DEVICE FOR WATER

(76) Inventor: Wen Kuei Chang, Taipei Hsien (TW)

( * ) Notice: Subject to any disclaimer, the term of this patent is extended or adjusted under 35 U.S.C. 154(b) by 423 days.

(21) Appl. No.: 12/221,001

(22) Filed: Jul. 30, 2008

(65) Prior Publication Data

US 2010/0027186 A1 Feb. 4, 2010

(51) Int. Cl.

| | |
|---|---|
| ***H01T 23/00*** | (2006.01) |
| *A61H 33/00* | (2006.01) |
| *A61H 21/00* | (2006.01) |
| *A61H 33/06* | (2006.01) |
| *A61H 33/02* | (2006.01) |

(52) U.S. Cl. ..... 361/230; 361/231; 607/81; 607/84; 607/85; 607/86; 4/524; 4/525; 4/535; 4/536; 4/537; 4/546

(58) Field of Classification Search ..... 361/230–231; 607/81, 84–86; 4/524–525, 535–537, 546
See application file for complete search history.

(56) References Cited

U.S. PATENT DOCUMENTS

| | | | | |
|---|---|---|---|---|
| 7,341,597 | B2 * | 3/2008 | Tucek | 607/86 |
| 2009/0069870 | A1 * | 3/2009 | Haase et al. | 607/86 |

* cited by examiner

*Primary Examiner* — Dharti H Patel
(74) *Attorney, Agent, or Firm* — Charles E. Baxley

(57) ABSTRACT

A negative ion generating device includes a housing having a number of water flowing passages, a number of electrically conductive boards engaged with sockets of the housing and electrically coupled to negative and conductive electricity respectively and disposed alternatively with each other for generating an electromagnetic field in the water, a copper plate is disposed in the housing and disposed above the electrically conductive boards for attracting and removing positive ions and for generating negative ions, and a processor device coupled to the conductive boards for receiving signals and for controlling the conductive boards.

5 Claims, 5 Drawing Sheets

NEGATIVE ION GENERATING DEVICE FOR WATER

BACKGROUND OF THE INVENTION

1. Field of the Invention

The present invention relates to a negative ion generating device, and more particularly to a negative ion generating device including an additional copper plate for attracting and removing the positive ions and for allowing the negative ions to be generated and released and mixed within the water that may be provided to wash or clean the bodies or the feet of the users.

2. Description of the Prior Art

Typical water treatment devices comprise a number of first electrically conductive rings electrically coupled to positive electricity, and a number of second electrically conductive rings electrically coupled to negative electricity for generating an electromagnetic field in the water and for producing or increasing the organic electrolytic functionality of living cellular material and for washing or cleaning the bodies or the feet of the users.

However, the electrically conductive rings may not be easily manufactured and assembled, and may not be used to remove the positive ions and also may not be used to generate the negative ions that are good for the bodies or the feet of the users.

The present invention has arisen to mitigate and/or obviate the afore-described disadvantages of the conventional negative ion generating devices.

SUMMARY OF THE INVENTION

The primary objective of the present invention is to provide a negative ion generating device including an additional copper plate for attracting and removing the positive ions and for allowing the negative ions to be generated and released and mixed within the water that may be provided to wash or clean the bodies or the feet of the users.

In accordance with one aspect of the invention, there is provided a negative ion generating device comprising a housing for being disposed into a water containing device and including a lower housing member and, an upper housing member for forming a chamber in the housing, and including a number of passages formed in the housing for allowing a water to flow into and out of the chamber of the housing, and includes a number of sockets disposed in the lower housing member, a number of first electrically conductive boards engaged with the sockets of the housing and electrically coupled to negative electricity, a number of second electrically conductive boards engaged with the sockets of the housing and disposed alternatively with the first electrically conductive boards and electrically coupled to positive electricity, and the first and the second electrically conductive boards being provided for generating an electromagnetic field in the water, a copper plate disposed in the chamber of the housing and separated from the first and the second electrically conductive boards and disposed above the first and the second electrically conductive boards for attracting and removing positive ions and for generating negative ions, and a control device including a receptacle, a processor device disposed in the receptacle and electrically coupled to the first and the second electrically conductive boards for receiving signals from the first and the second electrically conductive boards, and including a transforming circuit for electrically coupling to an electric power source and for receiving an electric energy from the electric power source, and including a number of switches provided in the receptacle for controlling the processor device and the first and the second electrically conductive boards, and including a displayer for displaying an information of the negative ion generating device.

The lower housing member and the upper housing member are secured together with latches. The copper plate preferably includes a ring-shape.

The control device includes a detecting circuit and/or a timing circuit electrically coupled between the processor device and the transforming circuit.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
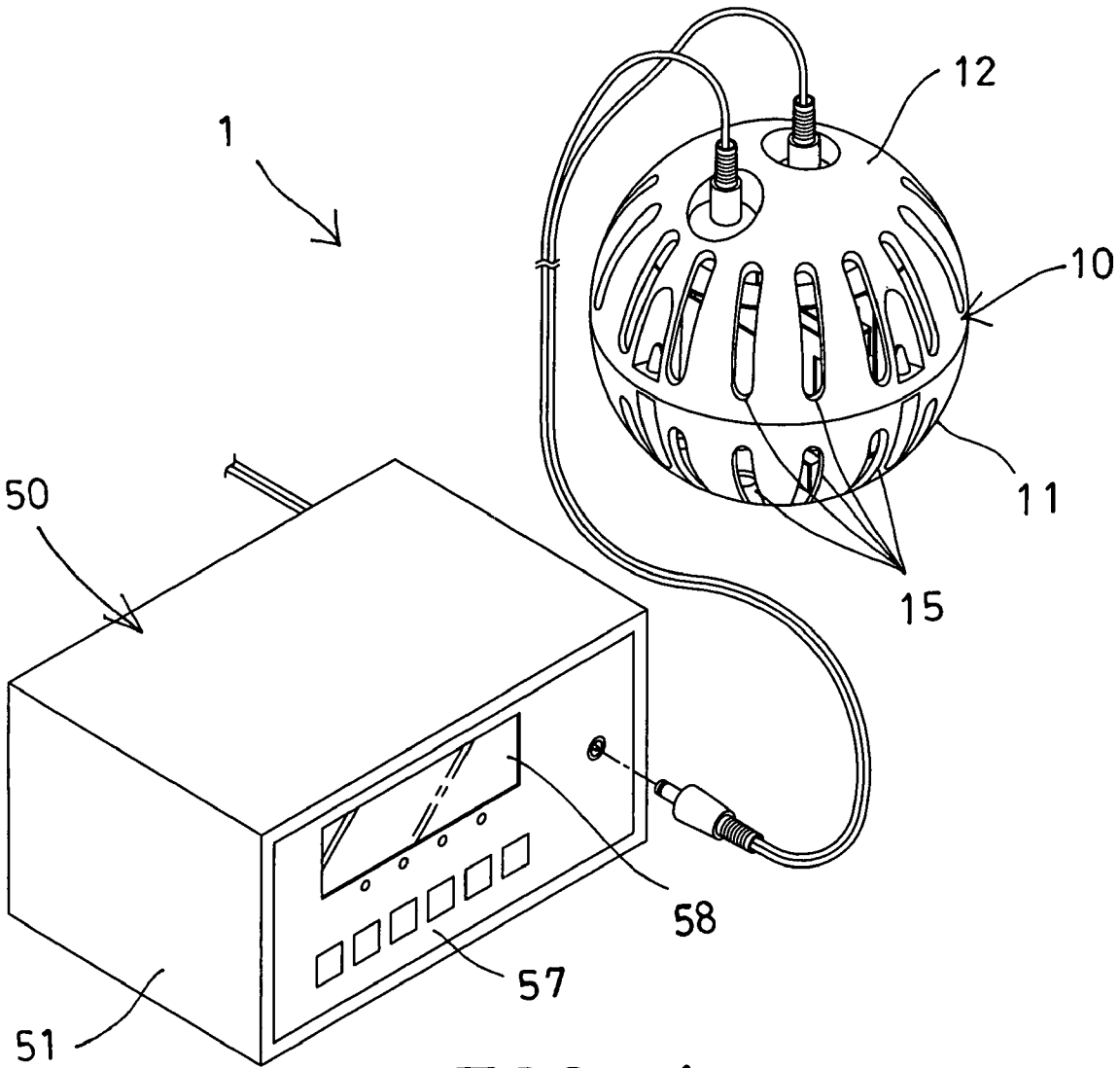
FIG. 1 is a perspective view of a negative ion generating device in accordance with the present invention.
Figure 2:
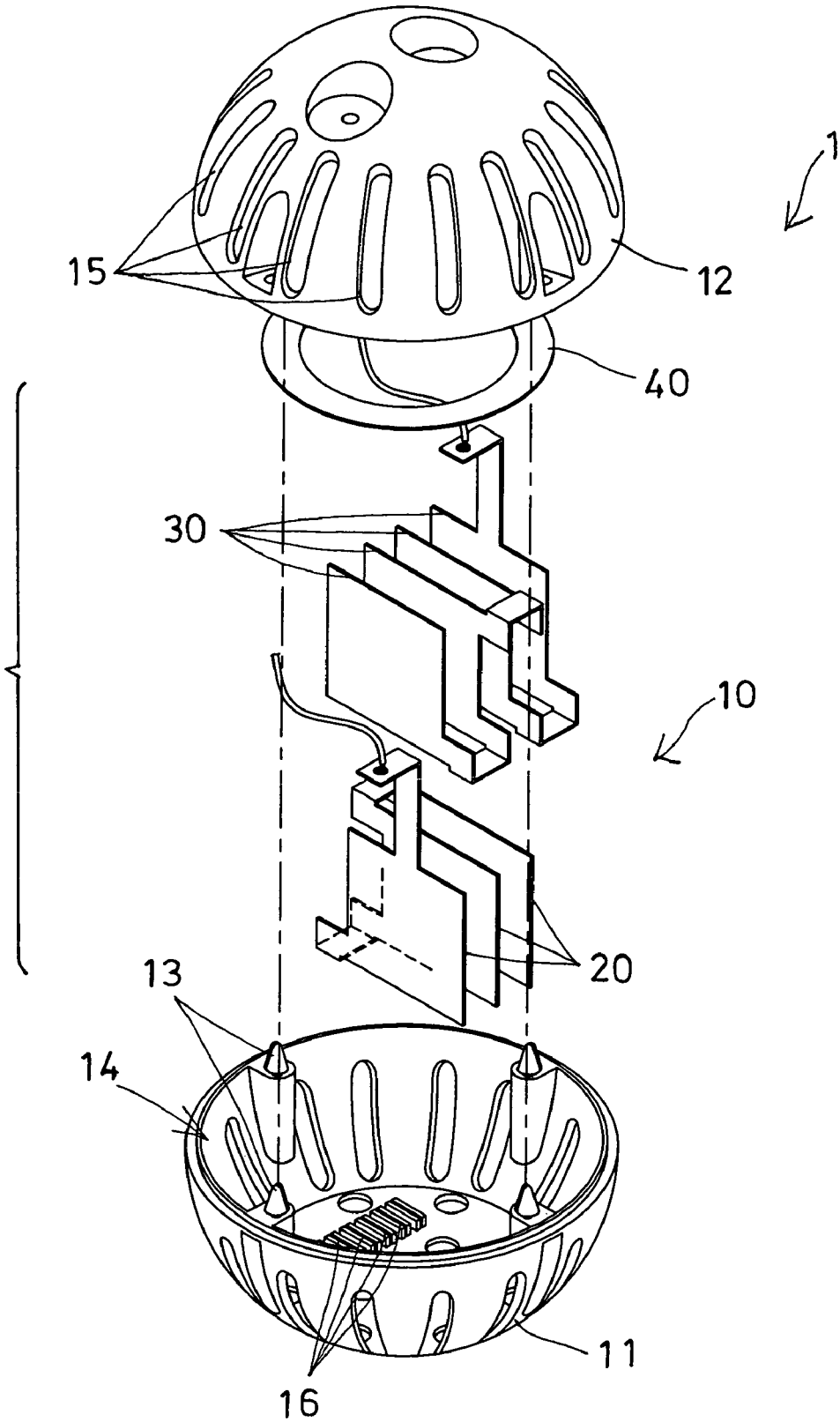
FIG. 2 is a partial exploded view of the negative ion generating device.
Figure 3:
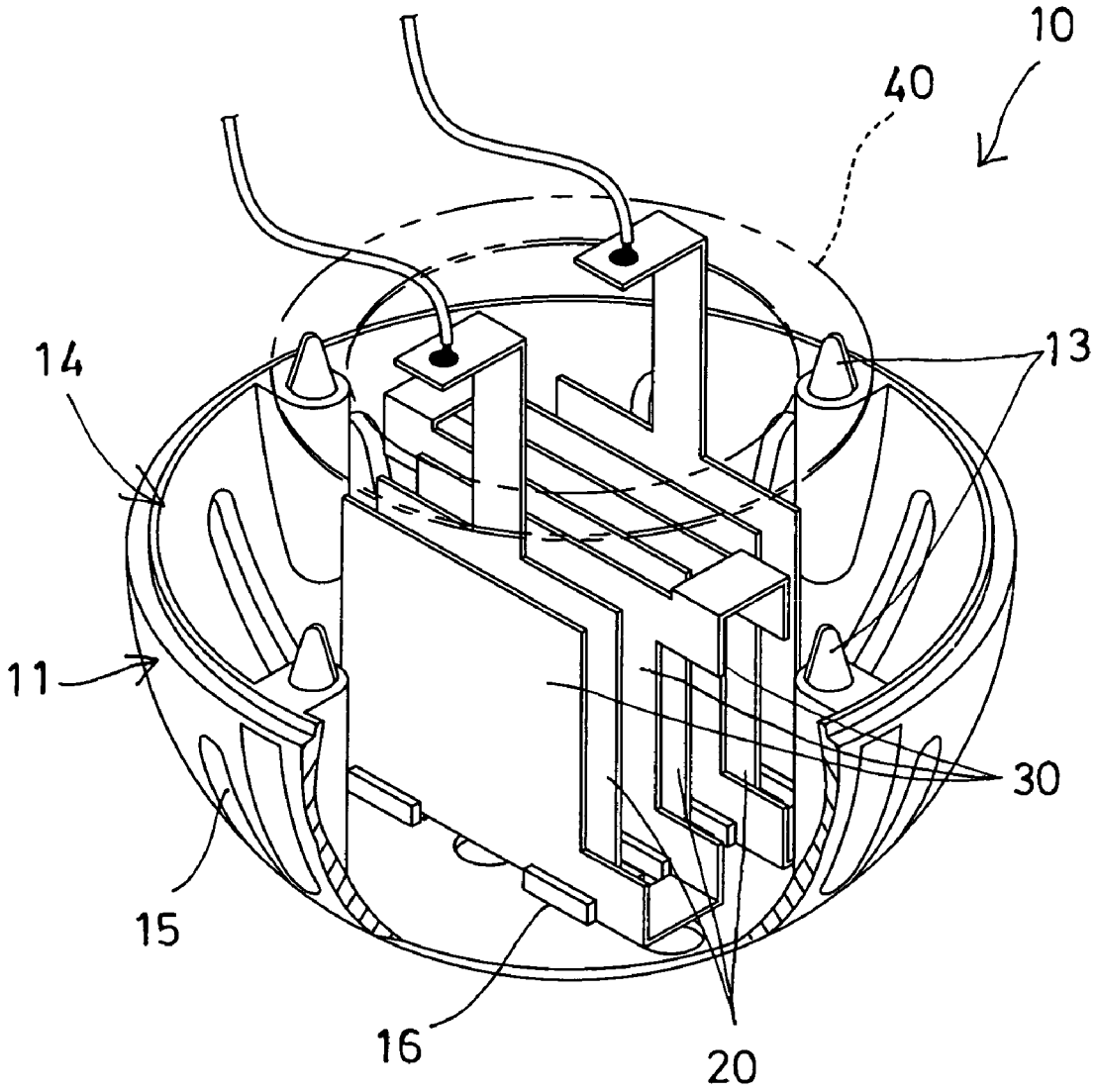
FIG. 3 is a partial perspective view illustrating a portion of the negative ion generating device.

Referring to the drawings, and initially to FIGS. 1-3, a negative ion generating device 1 in accordance with the present invention comprises a housing 10 for being disposed into a water containing device or basin or tub or pot, the housing 10 includes a lower housing member 11 and an upper housing member 12 to be secured together with fasteners or latches 13, adhesive materials and/or by welding processes, for forming a chamber 14 in the housing 10, and includes a number of orifices or passages 15 formed in either or both of the lower and the upper housing members 11, 12 for allowing the water to flow into and out of the chamber 14 of the housing 10, and includes a number of sockets 16 attached to or disposed in the lower housing member 11.

A number of first electrically conductive boards 20 are plugged to or engaged with the sockets 16 of the housing 10 and electrically coupled to negative electricity, and a number of second electrically conductive boards 30 are also plugged to or engaged with the sockets 16 of the housing 10 and disposed or arranged alternatively with or relative to the first electrically conductive boards 20 and electrically coupled to positive electricity, and the first and the second electrically conductive boards 20, 30 are provided for generating an electromagnetic field in the water and for producing or increasing the organic electrolytic functionality of living cellular material and for washing or cleaning the bodies or the feet of the users.

Figure 4:
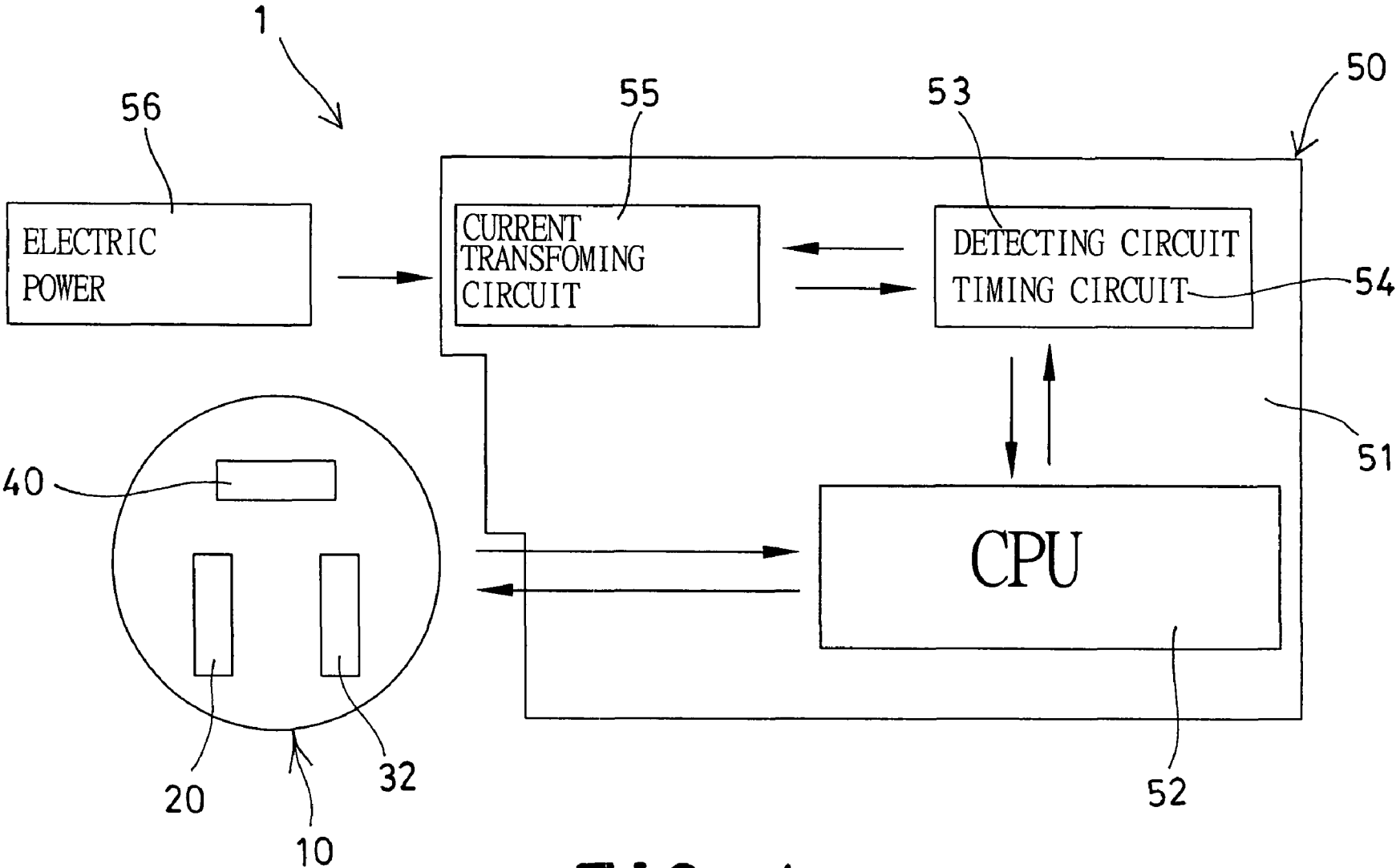
FIG. 4 is a plan schematic view of the negative ion generating device.

An additional copper plate 40 is further provided and disposed in the chamber 14 of the housing 10 and made of electrically conductive materials, particularly copper and/or the alloy thereof, and spaced or separated from the first and the second electrically conductive boards 20, 30 for preventing the copper plate 40 from being electrically contacted with the first and the second electrically conductive boards 20, 30, and the copper plate 40 preferably includes a ring-shape and is preferably disposed or arranged above the first and the second electrically conductive boards 20, 30, best shown in FIGS. 3 and 4, is provided for attracting and removing positive ions and for allowing negative ions to be generated and released and mixed within the water that may be provided to wash or clean the bodies or the feet of the users.

Figure 5:
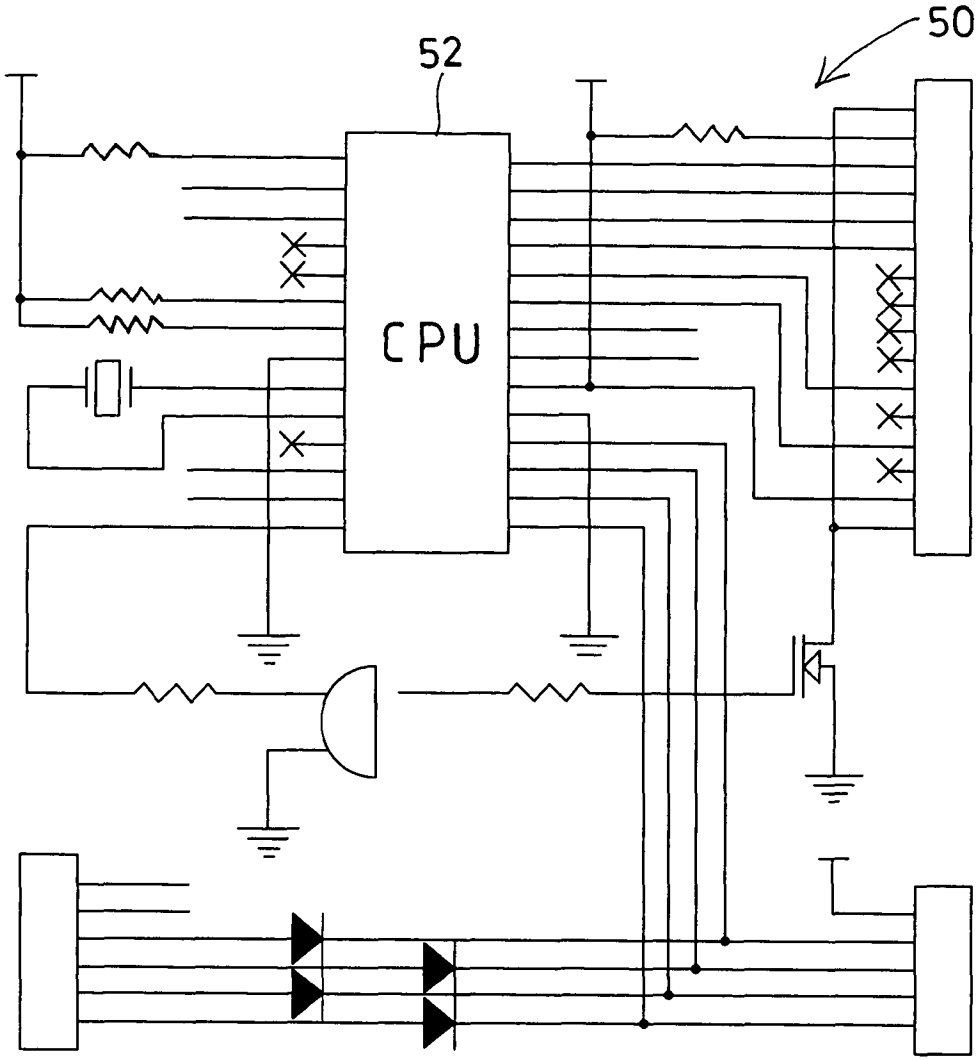
FIG. 5 is another plan schematic view illustrating the processor device of the negative ion generating device.

The negative ion generating device 1 further comprises a control device 50 (FIGS. 1, 4, 5) including a receptacle 51, a central processing unit (CPU) or processor device 52 disposed in the receptacle 51 and electrically coupled to the first and the second electrically conductive boards 20, 30 (FIG. 4) for receiving the signals from the first and the second electrically conductive boards 20, 30 and for supplying the suitable or selected or required electric power to energize the first and the second electrically conductive boards 20, 30 depending on the quantity of the mineral materials and/or other materials contained in the water.

The control device 50 further includes a detecting circuit 53 and/or a timing circuit 54 electrically coupled to the processor device 52, and a current transforming circuit 55 electrically coupled to the detecting circuit 53 and/or the timing circuit 54, and also electrically coupled to an electric power source 56 for receiving the electric power or energy from the electric power source 56 and for converting or transforming the alternative circuit into the direct circuit, such as 24V, 5 A, which may be used to energize the detecting circuit 53 and/or the timing circuit 54, and the processor device 52, and the first and the second electrically conductive boards 20, 30.

As shown in FIG. 1, the control device 50 further includes a number of switches 57 provided in or on the receptacle 51 for switching or controlling the processor device 52 and/or the first and the second electrically conductive boards 20, 30, and a screen or displayer 58 for showing or displaying the information of the negative ion generating device 1, such as the voltage or current supplied to the first and the second electrically conductive boards 20, 30, the setting time, the record or the information of the mineral materials and/or other materials contained in the water, the positive ions and/or the negative ions, and the like.

It is to be noted that the plate 40 may be made of the other electrically conductive materials, such as iron, aluminum, etc., but a large quantity of salt is required to be introduced into the water in order to increase the electrical conductivity of the water. However, when much more salt is introduced into the water, the electrical current may also be increased and may have a good chance to hurt the users. The plate 40 may also be made of the further electrically conductive materials, such as gold, silver, etc., but the expenses or the manufacturing cots for the negative ion generating device 1 may also be greatly increased, and the negative ion generating device 1 will become less competitive. Accordingly, copper and/or the alloy thereof will be the best materials for making the plate 40.

In operation, as shown in FIGS. 1 and 4, the housing 10 may be disposed into the water containing basin or tub or pot for generating the electromagnetic field in the water and for producing or increasing the organic electrolytic functionality of living cellular material and for washing or cleaning the bodies or the feet of the users, and the copper plate 40 may be provided for attracting and removing the positive ions and for allowing the negative ions to be generated and released and mixed within the water that may be provided to wash or clean the bodies or the feet of the users, and the negative ions are good for the health of the users. The switches 57 of the control device 50 may be provided for switching or controlling the processor device 52 and/or the first and the second electrically conductive boards 20, 30, such as for setting the operating time for the negative ion generating device 1.

Accordingly, the negative ion generating device in accordance with the present invention includes an additional copper plate for attracting and removing the positive ions and for allowing the negative ions to be generated and released and mixed within the water that may be provided to wash or clean the bodies or the feet of the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A negative ion generating device comprising:

a housing for being disposed into a water containing device and including a lower housing member and an upper housing member for forming a chamber in said housing, and including a plurality of passages formed in said housing for allowing water to flow into and out of said chamber of said housing, and includes a plurality of sockets disposed in said lower housing member, a plurality of first electrically conductive boards engaged with said sockets of said housing and electrically coupled to negative electricity, a plurality of second electrically conductive boards engaged with said sockets of said housing and disposed alternatively with said first electrically conductive boards and electrically coupled to positive electricity, and said first and said second electrically conductive boards being provided for generating an electromagnetic field in the water, a copper plate disposed in said chamber of said housing and separated from said first and said second electrically conductive boards and disposed above said first and said second electrically conductive boards for attracting and removing positive ions and for generating negative ions, and a control device including a receptacle, a processor device disposed in said receptacle and electrically coupled to said first and said second electrically conductive boards for receiving signals from said first and said second electrically conductive boards, and including a transforming circuit for electrically coupling to an electric power source and for receiving an electric energy from said electric power source, and including a plurality of switches provided in said receptacle for controlling said processor device and said first and said second electrically conductive boards, and including a displayer for displaying an information of said negative ion generating device.

2. The negative ion generating device as claimed in claim 1, wherein said lower housing member and said upper housing member are secured together with latches.

3. The negative ion generating device as claimed in claim 1, wherein said copper plate includes a ring-shape.

4. The negative ion generating device as claimed in claim 1, wherein said control device includes a detecting circuit electrically coupled between said processor device and said transforming circuit.

5. The negative ion generating device as claimed in claim 1, wherein said control device includes a timing circuit electrically coupled between said processor device and said transforming circuit.

* * * * *